United States Patent [19]

Mowbray et al.

[11] 4,154,370

[45] May 15, 1979

[54] DEVICE FOR POWDER METERING

[75] Inventors: Kenneth D. Mowbray, Des Plaines; Kenneth L. Hagen, Addison, both of Ill.

[73] Assignee: Electro Sprayer Systems, Inc., Rosemont, Ill.

[21] Appl. No.: 854,490

[22] Filed: Nov. 25, 1977

Related U.S. Application Data

[63] Continuation-in-part of Ser. No. 716,528, Aug. 23, 1976, Pat. No. 4,090,645.

[51] Int. Cl.[2] ..... B67D 5/54

[52] U.S. Cl. ..... 406/70; 222/414; 277/3

[58] Field of Search ..... 222/368, 414, 193, 194; 277/15, 3, 27

[56] References Cited

U.S. PATENT DOCUMENTS 3,178,236 4/1965 Mitchell ..... 222/368 X 4,071,253 1/1978 Heinen et al. ..... 277/3

*Primary Examiner*—Stanley H. Tollberg

*Attorney, Agent, or Firm*—McDougall, Hersh & Scott

[57] ABSTRACT

A powder metering device for distributing powder which is stored in a hopper, the powder then being delivered by the device to distributing nozzles. The metering device comprises a roller defining an engraved periphery which receives powder from the hopper. The roller carries powder at a controlled rate to a passage where the powder is then moved with the fluid to the distributing nozzles. The chamber holding the roller is maintained under positive pressure. Gaskets are located on opposite sides of the roller and maintained by the chamber pressure against the roll side walls and in engagement with the chamber walls. These gaskets, as well as the positive pressure conditions serve to discourage seepage of powder away from the path between the hopper outlet and the passage leading to the distributing nozzles.

12 Claims, 6 Drawing Figures

FIG. 1
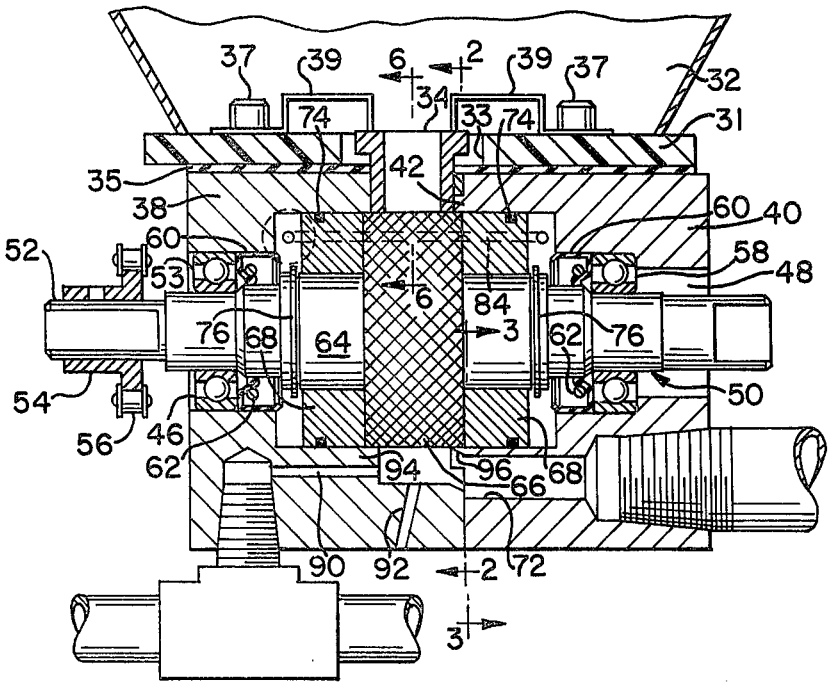
FIG. 6
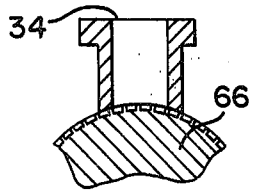
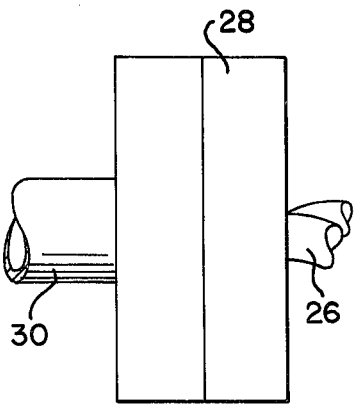
FIG. 3
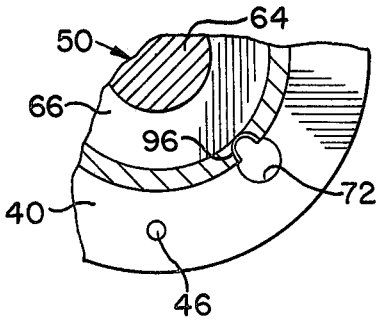
FIG. 2
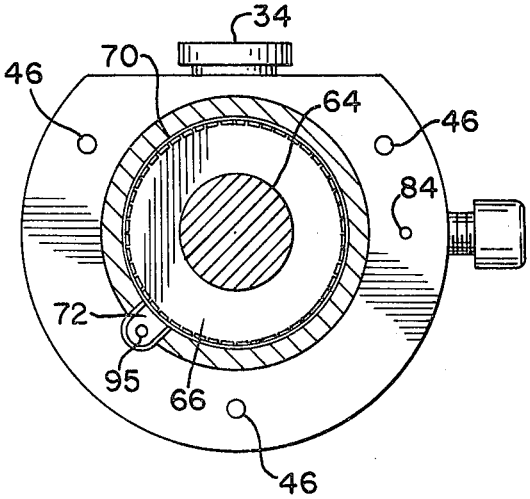
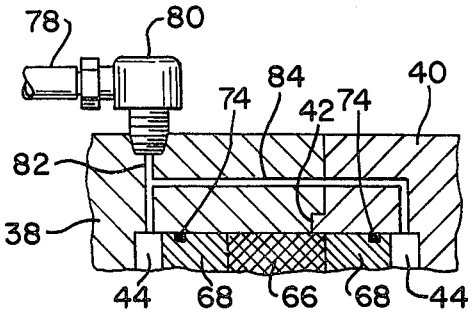
FIG. 4

DEVICE FOR POWDER METERING

This application is a continuation-in-part of applicants' copending application filed Aug. 23, 1976 Ser. No. 716,528, now U.S. Pat. No. 4,090,645.

BACKGROUND OF THE INVENTION

This invention is directed to constructions for the handling of powder and, in particular, to constructions which serve to deliver powder in a carefully controlled fashion. The invention is particularly usable in operations which involve the application of powder to the printed surfaces of sheets of paper or plastic and the like.

Electrostatic powder sprayers are widely employed as a means for applying anti-offset powders to the printed surfaces of sheets, webs and the like. Such application of powders takes place after printed material emerges from a printing press.

Powder utilized in such operations typically comprises a random mixture ranging in size from 5 to 100 microns. Because of the size of the particles involved, numerous problems have developed when attempting to uniformly distribute the powder over a sufficiently long period of time to provide an efficient operation. The small particle size, coupled with the size range involved, results in a material which cannot be handled on a predictable basis with systems previously available for use.

One attempt to solve the handling problems involved the use of a carburetor which fluidized powder in a jar-like container with the powder being contained in a rapidly moving air stream for movement to distributing means. Such systems utilize a needle valve or the like for increasing or decreasing the introduction of fluidizing air, and the air flow is continuously interrupted to provide for agitation of the powder. This arrangement leads to the removal of the smaller particles in the size range during the early stages of operation leading eventually to the presence of only the coarser fraction of the material for distribution. This necessitates continuing changes in operating conditions in order to maintain uniformity.

An alternative system utilizes a vibrator for sifting powder into a receiver where the powder is picked up by an air stream. It has been found, however, that the vibration of the powder results in packing and clogging. Furthermore, the necessity for agitation limits the size of such systems. Difficulties in providing uniformity are also experienced so that constant attention to flow control is required.

Another system utilizes a long fountain-type powder hopper placed across the path which the sheets must pass on the way to the delivery pile, and this system is an improvement. Typically, the system employs a textured or engraved roller upon which powder is metered by using a steel or plastic blade in contact tangentially with the roller. This provides an even coating of powder which is carried out of the hopper into an alternating high voltage field generated by a neon static tube. The powder particles are blasted off the roller surface and then fall, sometimes assisted by a gently flowing curtain of air, to the sheets. The degree of powder application is controlled by varying the speed of the roller.

In this system, the hopper, blade, roller and tube must extend across the entire width of the press, as close to the sheets as possible, and in the correct position. The result is that filling of the hopper requires shutting down the machinery, and a man then ladles powder into the hopper. This is not easily done on some machines.

Automatic filler equipment has been proposed for feeding powder into such hoppers. This equipment is limited in application to systems where nearly straight line access is available at the end of the hopper, from outside the press frames. This sometimes results in awkward or impossible placement of the filler hopper. In any event, the system has not proven reliable enough to receive general acceptance.

Applicants' aforementioned copending application is designed to overcome the problems experienced with prior art systems. That construction provides for large capacity as well as great uniformity of operation so that the attention necessary for insuring uniform powder distribution is greatly reduced. The construction specifically comprises a system for distributing powder wherein the powder is stored in a hopper and delivered to distributing means for the application of the powder to printed surfaces or for similar purposes. Metering means in the form of a roller are interposed between the hopper and the distributor. Means are provided for maintaining a substantially constant amount of powder on the roller surface, a doctor blade preferably being utilized for this purpose.

A source of compressed air is introduced into a passage which communicates with the roller surface. As the roller introduces powder into the vicinity of the passage, the compressed air picks up the powder for movement to the distributing means. One or more secondary air inlet openings communicate with the passage for supplying air or other fluid which is maintained at a pressure, such as ambient pressure, lower than the pressure of the compressed air. The low-pressure fluid is introduced in response to negative pressure conditions which are otherwise developed within the passage, this feature providing uniformity in the flow of the air-powder mixture to the distributing nozzles.

SUMMARY OF THE INVENTION

This invention is directed to a powder metering device for distributing powder which is stored in a hopper, the powder then being delivered by the device to distributing nozzles. The metering device comprises a roller defining an engraved periphery which receives powder from the hopper. The roller carries powder at a controlled rate to a passage where the powder is exposed to a pressurized fluid such as air, and the powder is then moved with the fluid to the distributing nozzles. The chamber holding the roller is maintained under positive pressure, and gaskets are located in the chamber. The chamber pressure maintains the gaskets against the roll side walls and in engagement with the chamber walls. These gaskets, as well as the positive pressure conditions serve to discourage seepage of powder away from the path between the hopper outlet and the passage leading to the distributing nozzles.

The particular construction of this invention provides improved reliability in metering, particularly from the standpoint of uniformity of powder flow. The construction is also particularly easy to maintain and includes features which minimize wear and other factors which can cause maintenance difficulties.

The metering device feeds nozzles which, along with their associated fittings are adapted to be enclosed in a housing adjacent the path of sheet movement. The housing protects these parts from exposure to powder and other contaminants further simplifying maintenance operations.

BRIEF DESCRIPTION OF THE DRAWINGS

FIG. 1 is a fragmentary cross-sectional view of a powder metering device characterized by the features of this invention;

FIG. 2 is a cross-sectional view of the powder metering device taken about the line 2—2 of FIG. 1;

FIG. 3 is a fragmentary cross-sectional view taken about the line 3—3 of FIG. 1;

FIG. 4 is a fragmentary cross-sectional view illustrating the chamber pressure lines utilized in the construction;

DETAILED DESCRIPTION OF THE INVENTION

Figure 5:
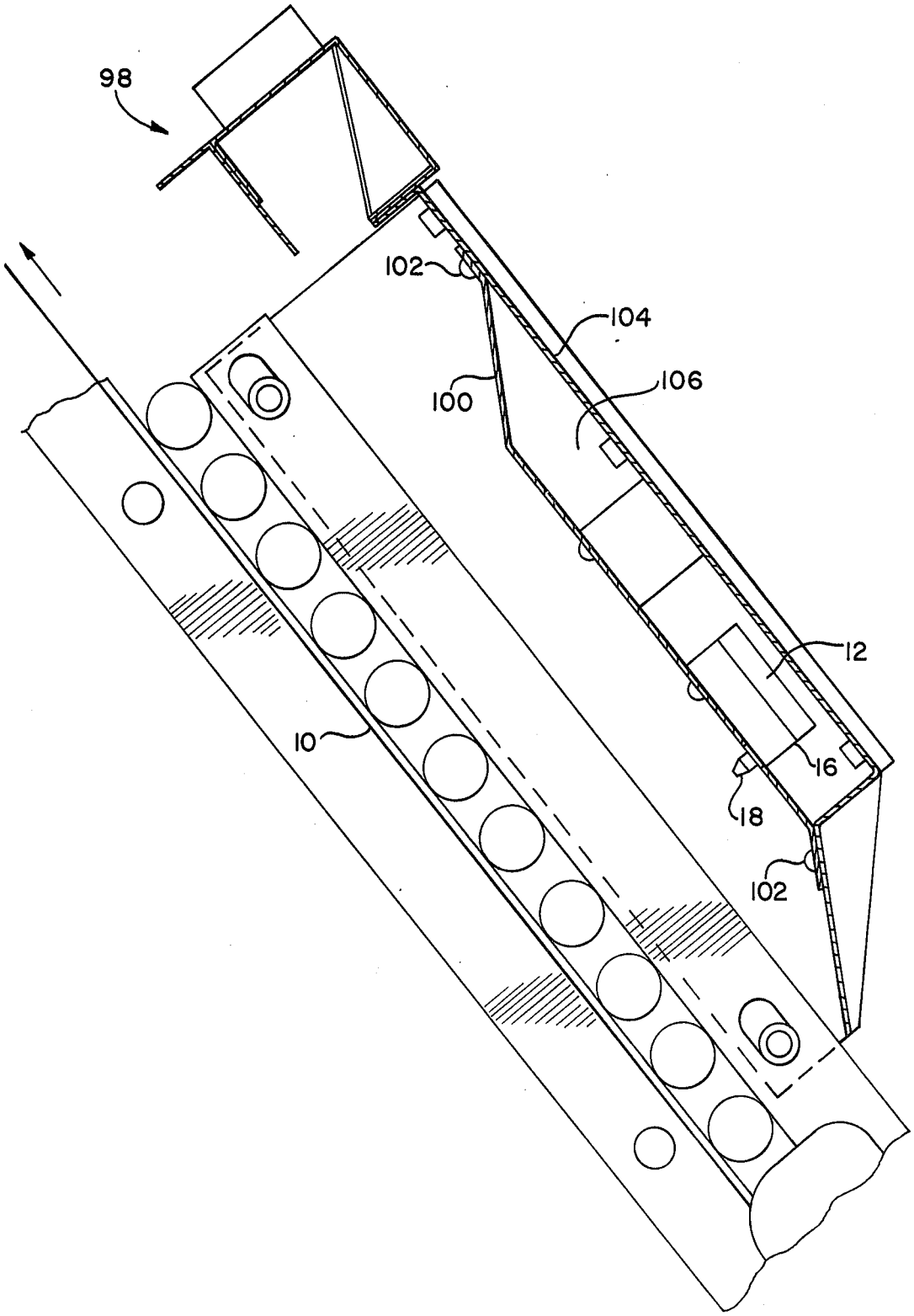
FIG. 5 is a cross-sectional view illustrating the nozzle assembly fed by the metering device in association with a housing adjacent the path of sheet movement; and, FIG. 6 is a detailed, cross-sectional view of a metering sleeve utilized in the construction.

The accompanying drawings illustrate in detail the concepts of the invention. Referring to FIG. 5, a web or sheet 10 which is to be exposed to powder is moved in a path adjacent on assembly employed for delivering powder to the web surface. This assembly includes a mounting bar 12 supported at its ends by any suitable means. The mounting bar carries a plurality of nozzle units 16 with each unit carrying a plurality of nozzle heads 18.

Hoses (not shown) extend from the nozzle units to intermediate manifolds which are fed by flexible hoses 26 connected to a main manifold 28 as shown in FIG. 1. A pipe 30 is connected to the manifold 28 for feeding the air-powder mixture to this manifold. Reference is made to the aforementioned copending application for a more complete description of a manifold and hose system which may be used in conjunction with the metering device used for supplying this air-powder mixture.

As shown in FIG. 1, the powder employed for forming the mixture is stored in a hopper 32. This hopper tapers downwardly to a discharge end, and means for metering powder discharged from the hopper are located in this position.

The bottom wall 31 of the hopper defines an opening 33 which receives metering sleeve 34. As best shown in FIG. 6, the metering sleeve defines a curved bottom edge which engages a metering roller to be described. A pair of bolts 37 secure the bottom wall to fittings 38 and 40 of the metering device which includes the metering roller. A spacer 35 may be utilized intermediate the bottom wall and the upper surface of the fittings.

The bolts are also utilized for holding leaf springs 39 in position on the wall 31. These leaf springs each define end portions which engage the top surface of metering sleeve 34. The leaf springs operate to press the metering sleeve against the metering roller, and it will be appreciated that only a light pressure is required. These springs particularly serve to accommodate wear of the sleeve which occurs after extended use of the construction. Thus, the sleeve will essentially maintain the same relationship with the metering roller even after wear.

The metering device comprises the fittings 38 and 40 with the latter defining an inwardly extending annular shoulder 42 which mates with a corresponding depression in the fitting 38. As best shown in FIG. 2, each of the fittings defines bores 46 whereby suitable fasteners can be employed for securing the fittings in assembled relationship.

The fittings each define internal cavity portions whereby the assembled fittings form a chamber 44. Aligned openings 48 are also defined by the fittings whereby a shaft 50 is adapted to be received by these openings and to extend within the chamber 44. As indicated, one end 52 of the shaft has a sprocket 54 attached thereto with chain 56 extending to a suitable drive whereby the shaft is adapted to be rotated relative to the fittings.

Suitable bearings 58 are employed in a conventional fashion. Seals 60 are positioned inwardly of these bearings with flexible 0-rings 62 urging the inner portions of the seals into engagement with shaft surfaces. These seals may be conventional oil seals which will function to prevent the seepage of oil used for the bearings into the chamber 44. The seals also serve to inhibit passage of fluid outwardly of the chamber 44 as will become more apparent.

The shaft 50 includes a larger diameter central section 64 which supports the metering roller 66. This roller may be press-fit on the shaft, keyed to the shaft, or otherwise maintained for rotation with the shaft. The roller 66, as explained in the aforementioned copending application comprises an engraved periphery and a space 70 formed between the roller periphery and the adjacent wall of the chamber 44 provides a path of movement for powder from the sleeve 34 to the exit passage 72. Even though the sleeve bears against the roller, the engraved character ensures passage of powder away from the sleeve.

Also positioned around this shaft portion 63 on opposite sides of the roller 66 are annular seals 68. In accordance with this invention, the seals 68 are dimensioned to fit snugly against the inner wall of chamber 44. Additional engagement with the inner wall is provided by 0-rings 74 associated with the seals 68. With this arrangement, the roller 66 and the shaft 64 will rotate relative to the seals 68.

The seals 68 are preferably formed of a plastic material having very high wear characteristics, for example, a tetrafluoroethylene composition including a glass and molybdenum particle dispersion marketed under the trademark Flouralloy A. In addition, the side walls of the roller 66 are lapped for purposes of minimizing wear and friction.

The seals 68 are held in assembly with the shaft 64 by means of retaining rings 76. This arrangement is particularly suitable for maintenance purposes since the entire assembly of the shaft, roller and seals can then be withdrawn after the fitting 38 is separated from the fitting 40.

The seals 68 are provided for purposes of inhibiting the seepage of powder from the desired path of movement into the chamber 44. Thus, in order to maintain uniformity of powder feed and also to minimize maintenance problems, it is highly desirable to insure passage of all powder to the discharge passage 72.

The chamber 44 is maintained above atmospheric pressure. This is accomplished most readily by introducing air through line 78 (FIG. 4) although the invention contemplates the utilization of a different fluid if the metering device should be utilized for a material which is subject to contamination by air. This invention will be explained relative to the provision of pressurized air in the chamber 44 and in passage 72 although other fluids are contemplated in both instances.

The line 78 extends to fitting 80 which is attached to fitting 38 whereby air will be introduced into internal bore 82. The bore 82 communicates with chamber 44 on one side of the roller 66 while an additional bore 84 extends to the portion of chamber 44 on the opposite side of the roller. It will be appreciated that portions of the bore 84 are formed in the respective fittings 38 and 40 so that these portions must be aligned when the fittings are assembled.

The introduction of pressurized air into the chamber 44 between 6 and 15 psi, for example at 9 psi, provides a highly effective means for insuring that the seals 68 efficiently inhibit movement of powder away from roller 66. The pressurized air forces the seals into intimate engagement with the sides of roller 66 and the air itself inhibits movement of powder away from the roller. Specifically, to the extent that any openings exist between the seal peripheries and the inner wall of chamber 44, an air pressure barrier against movement of powder away from the roller is developed.

The pressure in chamber 44 also effectively prevents movement of oil or the like inwardly toward the chamber. Thus, the seals 60 are forced into intimate engagement with the adjacent fitting and shaft surfaces by the air pressure, and the air pressure itself also forms a barrier to the movement of any material into the chamber 44.

As explained in the aforementioned copending application, pressurized air is also introduced through bore 90 for admixture with powder within the passage 72. Opening 92 is provided for utilizing pressure within the chamber as explained in that application. The design of the fittings 38 and 40 also takes into consideration the tendency of powder particles to migrate away from the desired path of movement. In this connection, it will be noted that the edge 94 of fitting 38 overlaps one side of roller 66 while the edge 96 of fitting 40 overlaps the other side of the roller. These overlapping edges provide an effective barrier to the movement of powder toward the seals 68. The edge 96 is tapered to provide a smooth flow toward the exit end of passage 72.

The overlapping edges 94 and 96 also protect the seals 68 from a "sand blasting" effect which could otherwise result if the seals were exposed to the pressurized air-powder mixture in the passage 72. This arrangement thus promotes longer life for these seals.

The tendency of the powder to create maintenance problems also exists in the area of the mechanisms employed for discharging the air-powder mixture onto the sheet 10. As shown in FIG. 5, the discharge means include nozzle heads 18 and ideally all powder is directed by these heads onto the sheet 10. In practice, however, powder tends to build up in this area of the equipment, and for this reason, excess powder collecting equipment is provided at 98. Even this equipment, however, is not capable of removing all excess powder, and powder in this area will collect on exposed surfaces creating contamination and maintenance problems. This has been particularly true with respect to the nozzle and manifold equipment discussed above.

As shown in FIG. 5, the contamination problems are met by utilizing a sheet metal cover 100. This cover is held by means of fasteners 102 on wall 104, and a chamber 106 is defined between the wall and the cover. The nozzle structures include nozzle units 16 and mounting bar 12. Only the nozzle heads 18 are exposed whereby the cover 100 substantially minimizes the tendency toward powder build-up on critical surfaces.

The above described construction provides a metering device which has been found to be highly reliable from the standpoint of uniform delivery of material and also from the standpoint of minimum maintenance. As noted, the roller 66 is included within a chamber so that a feed path for the powder of constant dimensions is established between the sleeve 34 and passage 72. As explained in the aforementioned copending application, a variable speed motor is employed for driving the roller so that the rate of powder feed can be precisely controlled by varying the roller speed. When the specific improvements of this invention relating to the inhibiting of powder movement away from the desired path and relating to reduction of maintenance problems are considered, the over-all value of the construction will be apparent.

It will be understood that various changes and modifications may be made in the above described construction which provide the characteristics of the invention particularly as defined in the following claims.

That which is claimed is:

1. In a construction for distributing powder wherein the powder is stored in a hopper and delivered from the hopper to distributing means, metering means interposed between said hopper and said distributing means, said metering means comprising a roller, means for delivering powder from the hopper into contact with the roller, a passage extending away from said roller to said distributing means, means for mixing said powder with a fluid and means for delivering the powder and fluid mixture to said distributing means, the improvement wherein said roller is mounted for rotation within a chamber with the space between the roller periphery and chamber walls defining the path of movement of the powder to said passage, a pair of seals within said chamber engaging the opposite side walls of said roller, and fluid pressure means for said chamber operating to force said seals against said roller to thereby discourage powder seepage away from said path.

2. A construction in accordance with claim 1 wherein said seals comprise annular members, the outer peripheries of said seals fitting within said chamber in close engagement with the inner walls of the chamber.

3. A construction in accordance with claim 2 wherein any openings between said walls and said seals are exposed to said fluid pressure to thereby further discourage seepage of powder away from said path.

4. A construction in accordance with claim 3 wherein said roller is mounted on a rotatable shaft, said seals being received around said shaft in close engagement therewith, said shaft being rotatable within said seals.

5. A construction in accordance with claim 4 including retaining rings adjacent said seals on the sides of the seals opposite said roller, said shaft being removable from the construction with said retaining rings holding the seals and roller in assembly with the shaft.

6. A construction in accordance with claim 1 wherein said seals are formed of a high wear-resistant plastic, said roller side walls defining a lapped surface whereby a minimum of wear and friction is developed as a result of rotation of said roller relative to said seals.

7. A construction in accordance with claim 4 including additional seals positioned around said shaft at the respective outer ends of said chamber, said seals in combination with said fluid pressure operating to prevent the entry of material into said chamber.

8. A construction in accordance with claim 4 wherein said metering means comprises a pair of fittings, fasteners for maintaining the fittings in assembled relationship, opposed cavities defined by the fittings, said cavities providing said chamber when the fittings are assembled, and aligned openings defined by the respective fittings for receiving said shaft.

9. A construction in accordance with claim 8 including a pressurized fluid inlet for said passage, said fittings defining bores communicating with said chamber on each side of said roller.

10. A construction in accordance with claim 8 wherein sections of said fittings extend into overlapping relationship with said roller adjacent the end of said path, said sections acting as barriers to the movement of powder out of said passage and acting as shields against the exposure of said seals to said powder.

11. A construction in accordance with claim 1 wherein said means for delivering powder from the hopper into contact with the roller comprise a plastic metering sleeve, the bottom edges of said sleeve conforming with the roller periphery whereby the edges act as a doctor blade to thereby limit the powder delivered to the roller.

12. A construction in accordance with claim 1 wherein said distributing means comprise nozzle units mounted adjacent the path of movement of a sheet to which the powder is to be applied, said units including nozzles, a protective cover for said units, said cover defining openings for nozzle heads carried by said units whereby only the nozzle heads are exposed to powder present in the area between the sheet and the distributing means.

* * * * *